United States Patent [19]

Gorman et al.

[11] 4,117,288

[45] Sep. 26, 1978

[54] VACUUM TYPE CIRCUIT INTERRUPTER WITH A CONTACT HAVING INTEGRAL AXIAL MAGNETIC FIELD MEANS

[75] Inventors: Joseph G. Gorman, Murrysville; James F. Roach, Oakmont, both of Pa.; Paul O. Wayland, Montour Falls, N.Y.

[73] Assignee: Westinghouse Electric Corp., Pittsburgh, Pa.

[21] Appl. No.: 699,770

[22] Filed: Jun. 25, 1976

[51] Int. Cl.[2] ..... H01H 9/44; H01H 33/18

[52] U.S. Cl. ..... 200/144 R; 200/147 R

[58] Field of Search ..... 200/144 R, 144 A, 144 B, 200/147 R

[56] References Cited

U.S. PATENT DOCUMENTS 3,980,850 9/1976 Kimblin ..... 200/144 B

*Primary Examiner*—Robert S. Macon
*Assistant Examiner*—Leonard W. Pojunas, Jr.
*Attorney, Agent, or Firm*—W. G. Sutcliff

[57] ABSTRACT

A vacuum type circuit interrupter is provided with contacts which include an integral axial magnetic field generating means. In one embodiment, a disc-like contacting portion is supported from the contact base, with a pair of half-turn conductive coil pieces extending between the base and the disc-like contacting portion. In another embodiment, the contacts have a cup-shaped base portion with a radially inwardly directed lip portion at the end of the cup-shaped portion to serve as the normal current carrying contact when the contacts are closed. The lip portions of these cup-shaped contacts are parted when the contacts are moved to the open position and the initial arc travels in a circular path around the annular lip. An auxiliary recessed disc-like contact portion is provided within the space defined by the cup-shaped base contact portion. The disc-like contact portion is supported from the base portion, and half-turn conductive coil pieces extend between the disc-like portion and the base portion of the contact so that an axial magnetic field may be generated when the contacts are in the open position.

7 Claims, 4 Drawing Figures

VACUUM TYPE CIRCUIT INTERRUPTER WITH A CONTACT HAVING INTEGRAL AXIAL MAGNETIC FIELD MEANS

BACKGROUND OF THE INVENTION

The present invention relates to vacuum type circuit interrupters in which movable contact electrodes are disposed within a housing which is sealingly evacuated. The contacts are movable between a closed position in conductive engagement, and an open position where the contacts are spaced apart to form an arcing gap between them. The arc formed during interruption conducts the circuit current and will extinguish at a natural current zero of the alternating current wave. The gap between the spaced apart open contacts will quickly recover to the high vacuum state to withstand the ensuing recovery voltage without a reignition of the arc. Thus, the circuit current is effectively interrupted.

It is well known in such vacuum type circuit interrupters that the current interruption capability of the interrupter can be increased by applying an axial magnetic field. The field direction is along the direction of arcing to reduce the arc voltage and to maintain a diffused arc. This will prevent overheating of the contacts which could lead to reignition of the arc. Data has been presented to this end in the article "Interruption Ability of Vacuum Interrupters Subjected to Axial Magnetic Field", Proceedings of the IEE, Volume 119, pages 1754–1758 (1972). Similar improvements achieved with axial magnetic fields have been reported by others. While the desirability of establishing axial magnetic fields is well known, researchers have continued to search for a practical convenient way of generating such an axial magnetic field. Early work dealt with providing coils outside of the interrupter housing, and more recently as in U.S. Pat. No. 3,244,843, coils have been attached to the rear surface of the contact electrodes. Others, as in U.S. Pat. No. 3,158,722, have attempted to configure the electrode supporting conductive rod in a field generating configuration. More recent attempts are seen in U.S. Pat. Nos. 3,823,287 and 3,852,555.

In U.S. Pat. No. 3,946,179 an axial magnetic field generating means is shown as part of the contact. The field coil is formed by a plurality of radial spokes and connected circumferential rim pieces. This contact will have an axial field generated during normally closed load current carrying operation. The design has limitations on interrupting under high voltage, high current conditions.

The concept of using circumferentially directed magnetic fields to drive the arc around or about the contact surface preventing arc melting of the contact is also well known in the vacuum interrupter contact art. Recent designs in this area include cup-shaped designs with slotted side walls, and a radially inwardly extending lip portion at the contact surface as seen in U.S. Pat. No. 3,836,740. In copending application Ser. No. 540,206, entitled "Cup-Shaped Contacts for Vacuum Interrupters Having a Continuous Annular Contact Surface," which application is owned by the assignee of the present invention, a solid annular contact is provided over the slotted lip portion of a cup-shaped contact.

It is desired that the vacuum interrupter be usable at the highest possible voltage and current ratings. The closed contacts of the interrupter must be designed to carry normal high current load currents with minimum power dissipation, and yet to be able to be separated when a fault is detected at a random point on the power wave. The interrupter must effectively interrupt after being opened at any instantaneous parting current which is many times the normal instantaneous load current. In order to interrupt on high voltage lines which have high parting currents, the contact must first survive the high power constricted arc which is capable of melting the contact and destroying the interrupter structure. The interrupter must also, once having survived the gross melting arc, be able to recover to withstand the high transient recovery voltage impressed across the contacts. As has been pointed out, the normal practice to avoid melting of the arcs is to utilize a circumferentially directed magnetic field force to rotate the arc or to utilize spiraled contacts to move the arc across the contact surfaces. The use of axial magnetic fields has been largely directed to the aspect of being able to maintain a low arc dissipation into the contacts thus enhancing the ability of the interrupter to withstand the high transient recovery voltage and to maintain the extinguishment of the arc. An axial magnetic field provides a low arc voltage and permits a very diffuse arc condition. The high voltage withstand characteristic of an open interrupter is of course dependent upon the distance of contact separation.

The above-described arrangements for producing axial magnetic fields in interrupters all have serious limitations. The normal load current flows continuously through the field inducing coils of some of the prior art devices which leads to a continuous and undesirable power dissipation. More importantly, the axial magnetic field is only effective if no gross melting arcing takes place initially. If the interrupter is to be used in high voltage, high fault current circuits, the parting of the contacts could occur at high fault current values and an axial magnetic field would not control the intense arc formed.

It is the object of the present invention to provide a contact including means for controlling this initial arcing condition and to further provide axial magnetic field means and a contact surface which will prevent arc reignition.

SUMMARY OF THE INVENTION

An improved vacuum type circuit interrupter is provided with a contact structure which employs a disc-like arcing surface and an integral axial magnetic field producing means disposed behind the disc-like member.

In the preferred embodiment of the present invention, a composite contact structure is provided in which the disc-like arcing surface and integral axial magnetic field producing means is disposed within the recess of a cup-shaped contact member. This composite contact structure utilizes an annular contact lip at the confronting contact portions of the cup-shaped members of opposing contacts of the interrupter. The cup-shaped member is slotted as is well known to provide a circumferential magnetic force to move the initial constricted arc around the lip portion of the cup-shaped member and simultaneously drive the arc inward to the recessed disc-like arcing surface. The lip portion of the contact controls the arc during the first fractional half cycle of arcing current by preventing a damaging gross melting arc. The arcing current during the following half cycle is carried by the recessed disc-like arcing surface, and is kept diffuse by the axial magnetic field producing means which generates the axial field. The recessed disc-like contact portion and axial magnetic field means is designed to minimize the arcing energy density, and thus the contact temperature during the following half cycle, and to allow the interrupter to regain its dielectric strength at the time of the ensuing current zero.

In a simplified embodiment of the present invention the disc-like arcing surface and integral magnetic field producing means constitute the contact assembly.

DESCRIPTION OF THE PREFERRED EMBODIMENTS

Figure 1:
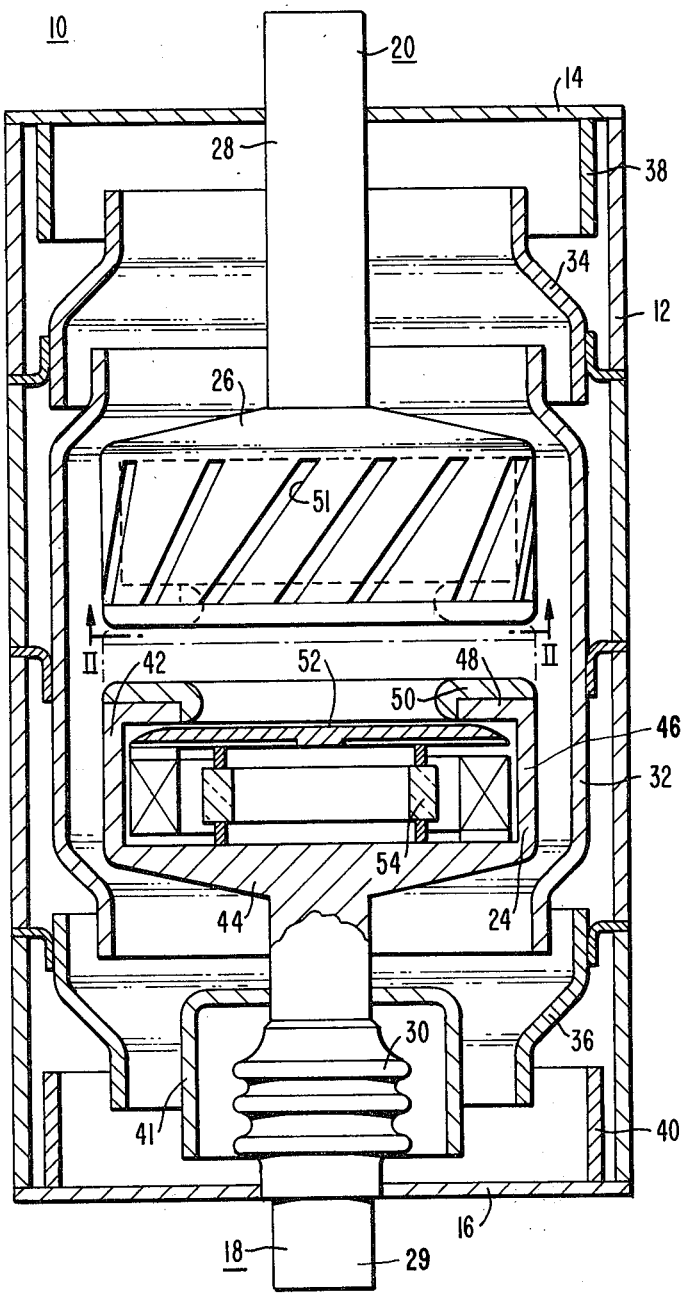
FIG. 1 is a side elevational view partly in section of the entire vacuum interrupter structure according to the preferred embodiment of the present invention.

The present invention can be best understood by reference to the drawings in which in FIG. 1 the vacuum interrupter structure 10 includes a generally cylindrical insulating housing 12, with hermetically sealed end plates 14 and 16 disposed in sealing arrangement at either end. The uppermost contact assembly 20 is the fixed assembly, while the lower contact assembly 18 is the movable contact assembly. The contact assembly 20 includes the conductive support rod 28 which is sealingly passed through the end plate 14 to permit electrical connection to the load line. The contacts 24 and 26 are identical contacts which are typically arranged in mirror-image fashion and are structurally described in detail hereafter. The movable contact assembly 18 includes a movable support rod 29 which is sealed to a bellows assembly 30 which is in turn sealed to the end plate 16 as is well known in the art. The movable contact assembly 20 is seen in phantom moved to the closed position in contact with contact assembly 18.

A plurality of generally tubular coaxial shield members are provided within the housing 12 spaced from the interior walls of the housing, again as is well known in the art. In the embodiment seen in FIG. 1, a central shield member 32 is provided about the contacts 24 and 26. An auxiliary set of auxiliary shield members 34 and 36 is provided at the opposed ends of the center shield 32 and a pair of annular end shields 38 and 40 are provided between the end plates and the auxiliary shields. A cup-shaped shield member 41 is provided over the bellows 30. The various shield members protectively overlap each other and prevent movement of any vaporized material to the housing member 12 to prevent overheating and fracturing of the housing. The shield members typically are at a floating electrical potential.

The contact structures 24 and 26 are identical with the upper contact 26 being seen from the side, and the lower contact 24 is broken away to show in section the complete electrode structure. The contacts 24 and 26 each comprise a cup-shaped base member 42 which is electrically connected to the respective conductor support rods 18 and 20 at the extending ends of such rods. The cup-shaped base member 42 has a generally planar end portion 44, side wall portion 46, and an inwardly radial directed annular lip portion 48. The cup-shaped base member 42 as well as the annular lip portion 48 are slotted as is well known in the art as described in U.S. Pat. No. 3,836,740 to provide a circumferentially directed drive force for the constricted arc which will form when the contacts are moved apart. It is desirable to provide a solid annular contact surface 50 which is attached to the lip contact portion 48, with the slots 51 in the lip and side wall portions providing the desired circumferential drive force, while the solid annular contact 50 serves as the actual arcing contact surface. Such a solid annular contact structure is described in greater detail in copending application Ser. No. 540,206, filed Jan. 10, 1975, owned by the assignee of the present invention, entitled "Cup-Shaped Contacts for Vacuum Interrupters Having a Continuous Annular Contact Surface". The angled slots 51 as described extend through the side walls 46 of the cup-shaped base member 42 and through the lip contact portions 48.

As can be seen most clearly for the lower contact assembly 18, a recessed disc-like contact portion 52 is supported within the recess or chamber defined by the cup-shaped base member 42. The disc-like contact portion 52 is recessed and spaced slightly from the lip portions 48 with annular support means 54 extending between the under side of the disc-like contact portion and the generally planar base of the cup-shaped base member 42. The axial magnetic field means 56 comprise a pair of half-turn conductive coil pieces 58 positioned between the disc-like contact portion 52 and the generally planar base portion 44 of the cup-shaped base 42. Opposed ends of each coil piece are connected respectively to the back side of the disc-like contact portion 52 and to the planar base portion 44 to provide a current path. The coil piece end connections are arranged to provide a common circular current flow direction with respect to each contact to provide a total additive axial magnetic field for both contacts 18 and 20.

Figure 2:
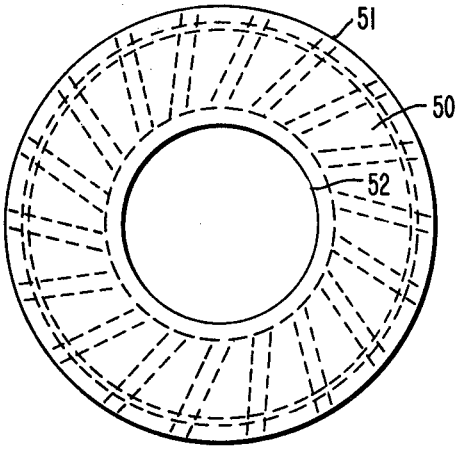
FIG. 2 is a plan view of the contact structure according to the embodiment of FIG. 1.
Figure 3:
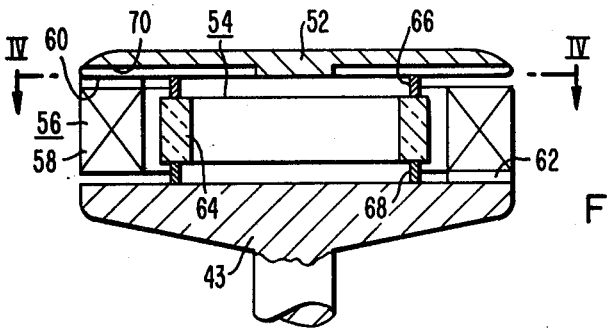
FIG. 3 is an enlarged side elevational view partly in section of the recessed contact portion of the embodiment of FIG. 1 taken along line III—III of FIG. 4.

The cup-shaped structure of the preferred embodiment is shown in detail in the enlarged plan and side view of FIG. 2. The slots 51 in the lip 48 and side wall 42 portions are cut to provide magnet drive forces to rotate the arc in a counterclockwise direction around the solid annular contact surface 50. The angled slots 51 in the lip portion 48 also tend to drive the arc toward the center of the contact and drive it on to the recessed disc-like arcing surface 52 provided within the chamber defined by the cup-shaped member. The structure of the disc-like contact and the axial magnetic field means 56 can perhaps be best appreciated by reference to FIG. 3, which also shows a simplified embodiment wherein the disc-like contact and axial means serve as the entire contact assembly. This contact assembly seen in FIG. 3 is the same structure as is fitted within the recess or chamber defined by cup-shaped member for the preferred embodiment of FIGS. 1 and 2. The axial magnetic field means 56 comprises two coil pieces 58 each of which are in effect a half circle generally planar conductive copper member which has raised end connections 60 and 62, one on each opposed side of the coil piece 58 to permit electrical connection respectively to the underside of the disc contact 52 and the planar base portion 44.

Figure 4:
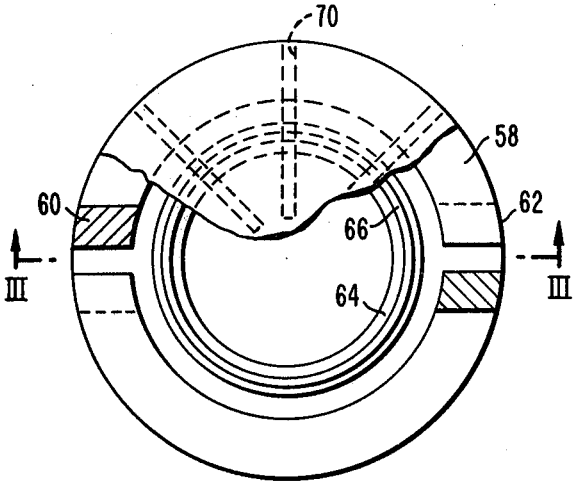
FIG. 4 is a plan view of the contact embodiment taken along line IV—IV of FIG. 3.

The support means 54 for supporting the disc-like contact 52 from the planar base portion 44 can be best understood by reference to FIGS. 3 and 4. It should be understood that this structure can be utilized in the preferred embodiment of FIG. 1, or constitutes the simplified embodiment without the cup-shaped portion.

The support means 54 comprises a cylindrical insulating ceramic member 64 with annular conductive supports 66, 68 provided on opposed ends of the ceramic member 64. The conductive supports 66 and 68 are in turn brazed or welded respectively to the back surface of the disc-like contact portion 52 and to the planar base portion 44. It is desirable that the coil pieces 58 have a radius or diameter as large as possible within the cup-shaped contact to permit provision of as uniform an axial magnetic field as is possible. It is also desirable that the disc-like contact portion 52 has as large a surface area as again is permitted within the cup-shaped contact.

Alternative support means could of course be provided or even eliminated if the coil pieces 58 and the end connection assemblies are such as to provide sufficient support for the disc-like contact in the recess portion of the preferred embodiment. The disc-like contact surface itself is not subjected to the significant abutting closing forces as are the solid annular contacts 46 on the lipped portions of the cup-shaped member during closing of the interrupter contacts, so that it is possible to support the disc-like contact portion 52 in a variety of ways. It is also possible to use a conductive support means rather than ceramic combination without significantly detracting from the current which will pass from the disc-like contact through the coil pieces to the planar base portion of the cup-shaped contact and out the conductive support rod. If a conductive support means is utilized, it should have a higher resistance than the copper coil pieces to insure that a high percentage of the current is in effect utilized in producing the axial magnetic field.

As has already been referred to, the embodiment seen in FIGS. 3 and 4, illustrates that the recessed contact portions described with reference to the preferred cup-shaped embodiment of FIG. 1, can be utilized separately as contacts in an interrupter without the cup-shaped contact portion. In this simplified embodiment, without the cup-shaped portion, the support means 54 for supporting the disc-like contact become more important because of the fact that the disc-like contact is the main contacting member which must be forced into abutting contacting current carrying relationship when the interrupter is disclosed.

In each of the embodiments it is desirable that the actual contact surfaces such as the solid annular contact 50 and the disc-like contact portion 52 be made of a contact material such as vacuum infiltrated copper-chromium, which is well known in the art for interrupter contacts. It is desirable that the other portions of the contact assembly be formed of a non-magnetic material such as stainless steel to minimize eddy current losses during the generation of the axial magnetic field. It is also desirable that radial grooves 70 be provided in the backside of disc-like contact portion 52 to minimize eddy current effects. These grooves 70 do not extend through the contact 52.

In the embodiment of FIG. 1, with the cup-shaped contact the axial magnetic field means is effectively by-passed during normal closed interrupter operation, with the load current being carried by the cup-shaped members and the solid annular contacts on the lip portion 48 down the slotted side wall 42, through the planar base portion 44 and out the conductive support rods. In this way current only flows through the magnetic coil when the arc has in effect transferred to the recessed disc-like contact surface. Eddy current losses can be minimized by slotting the contact assembly portions, as well as by using non-magnetic material such as stainless steel for non-arcing parts of the contact assembly.

In order to optimize the high voltage, high current interruption capability of the current interrupter of the present invention it is desirable that the contacts be moved apart very quickly and auxiliary means for driving the movable contact open may be employed. It is also desirable that the arc gap between the spaced open contacts be optimized to prevent restriking and to give a high voltage withstand capability. By way of example, for high voltage operation a gap spacing of about one inch is sufficient to provide the desired withstand voltage characteristic.

The preferred embodiment seen in FIG. 1, with the cup-shaped portion to rotate the intense arc initially, and the recessed disc-like contact portion with integral axial magnetic field means permits operation at high voltage and high current. The slotted cup-shaped portion with the solid annular contact surface will tend to drive the intense arc around and inward toward the inner perimeter of the annular solid contact surface. After current zero, the diffuse arc which forms will either form initially or be driven onto the disc-like contact surface because of the longer path of vapor density between the disc-like contact surfaces than between the solid annular surfaces. There will be a lower arc voltage existing between the disc-like contact surfaces, and any diffuse arc formed will establish itself in this low arc voltage region. This will permit the solid annular surface from which the initial intense arc was directed to cool. The high vacuum condition in the interrupter gap will thus be re-established and successful circuit interruption attained.

We claim:

1. A vacuum type circuit interrupter which includes a housing which is sealingly evacuated, with a pair of relatively movable contacts sealingly supported within the housing, which contacts are movable between a closed position in conductive engagement, and an open position spaced apart to form an arcing gap therebetween across which an arc forms during circuit interruption, the improvement wherein the contacts comprise a conductive base portion connected to a conductive support rod which sealingly extends through the housing, which base portion includes a cup-shaped side wall portion extending toward the opposed contact with a radially inwardly directed annular lip portion at the extending end of the cup-shaped side wall portion, with angled slots formed in the cup-shaped side walls and the annular lip portion to provide an arc rotating force for moving the arc around the annular lip portion, and wherein an annular solid contact rim is provided over the slotted lip portion to serve as the initial arcing surface when the contacts are separated, and wherein a disc-like contact portion is supported within the chamber defined by the cup-shaped side walls and lip of the base portion, by support means extending between the back of the disc-like contact portion and the base, with axial magnetic field producing means disposed within the chamber between the back side of the disc-like contact portion and the base, wherein the axial magnetic field producing means comprises a pair of half-turn conductive coil pieces which are each connected at one end to the back perimeter portion of the disc-like contact portion and at the other end to the base, with the coil pieces spaced between the disc-like contact portion and the base, with the coil piece connections arranged such as to provide a common circular current flow direction as to each contact to provide an additive axial magnetic field.

2. The vacuum type circuit interrupter set forth in claim 1, wherein the half turn coil pieces have a radius which is approximately equal to the radius of the disc-like contacting portion.

3. The vacuum type circuit interrupter set forth in claim 1, wherein the support means comprises a cylindrical ceramic piece with a radius less than the coil piece radius, and with annular metal members attached to opposed ends of the cylindrical ceramic piece, one such annular metal member connected to the base and the other to the back side of the disc-like contacting portion.

4. The vacuum type circuit interrupter set forth in claim 1, wherein the disc-like contacting portion is formed of copper-chromium contact material.

5. The vacuum type circuit interrupter set forth in claim 1, wherein the annular solid contact rim is formed of copper-chromium contact material.

6. The vacuum type circuit interrupter set forth in claim 1, wherein the base is formed of stainless steel.

7. A vacuum type circuit interrupter which includes a housing which is sealingly evacuated, with a pair of relatively movable contacts sealingly supported within the housing, which contacts are movable between a closed position in conductive engagement, and an open position spaced apart to form an arcing gap therebetween across which an arc forms during circuit interruption, the improvement wherein the contacts comprise a conductive base portion connected to a conductive support rod which sealingly extends through the housing, support means extending from the base portion toward the opposed contact comprising a cylindrical ceramic piece with a radius less than the coil piece radius, and with annular metal members attached to opposed ends of the cylindrical ceramic piece, one such annular metal member connected to the base and the other to the back side of the disc-like contact portion, a disc-like contacting portion spaced from the base portion with the support means extending between the base and the back side of the disc-like contacting portion, and axial magnetic field producing means disposed between the disc-like contacting portion and the base, which axial magnetic field producing means comprises a pair of half turn conductive coil pieces which are each connected at one end to the back perimeter portion of the disc-like contacting portion and at the other end to the base, with the coil pieces spaced between the disc-like contacting portion and the base with the coil piece end connections arranged such as to provide a common circular current flow direction as to each contact to provide an additive axial magnetic field.

* * * * *